United States Patent [19]

Ling

[11] Patent Number: 4,866,959

[45] Date of Patent: Sep. 19, 1989

[54] PUSHER-TYPE COMBINATION PADLOCK

[76] Inventor: Chong-Kuan Ling, c/o Sinox Co., Ltd., P.O. Box 53-58, Taipei, Taiwan

[21] Appl. No.: 276,111

[22] Filed: Nov. 25, 1988

[51] Int. Cl.[4] ..... E05B 37/14

[52] U.S. Cl. ..... 70/25; 70/312

[58] Field of Search ..... 70/22, 24, 25, 26, 312

[56] References Cited

U.S. PATENT DOCUMENTS 3,410,121 11/1968 Morin ..... 70/25
3,973,419 8/1976 Atkinson ..... 70/25 X
4,742,700 5/1988 Ling ..... 70/25

FOREIGN PATENT DOCUMENTS 64532 6/1946 Denmark ..... 70/312

*Primary Examiner*—Lloyd A. Gall

[57] ABSTRACT

A pusher-type combination padlock includes a movable shackle reciprocatively formed in a longitudinal side portion of the padlock having a pusher plate secured to the movable shackle slidably overlain on a cover of a padlock casing so that when rotating the dials and sleeves to their opening combination, the pusher plate can be pushed upwardly to open the movable shackle for opening the lock in an easier and comfortable way, especially for a better ergonomic effect.

16 Claims, 3 Drawing Sheets

PUSHER-TYPE COMBINATION PADLOCK

BACKGROUND OF THE INVENTION

A linearly operating side-locked padlock of U.S. Pat. No. 4,742,700 was disclosed by the same applicant of this application, in which the dials 3 are rotated to their opening numbers as predetermined to drive the clutch wheels 4 to their opening position, and the button 221 is depressed downwardly to lower the movable shackle fastener 23 to unlock the upper shackle 21 so that the opening or closing of the shackle is linearly operated by a user's single hand. It is really quick to operate the lock. However, when depressing the button 221 for opening the lock, one user's hand should hold the rectangular casing 1 to allow his (her) thumb to depress the button 221 and his (her) other fingers may not firmly clasp the movable shackle 23 to allow an opening stroke of the movable shackle 23, resulting in an unstable holding of the padlock. The opening movement of the movable shackle 23 may possibly injure the user's fingers as jammed between the shielding plate 232 and the right side wall 103 of the casing 1. So, the applicant's prior invention of U.S. Pat. No. 4,742,700 still has some drawbacks on an ergonomics point of view. It is therefore expected to invent a combination padlock to overcome the aforesaid ergonomic drawbacks.

SUMMARY OF THE INVENTION

The object of the present invention is to provide a pushertype combination padlock having a movable shackle provided with a pusher plate thereon so that the shackle may be directly pushed outwardly to open the padlock in an easy and comfortable way to enhance its ergonomic effect.

DETAILED DESCRIPTION

Figure 1:
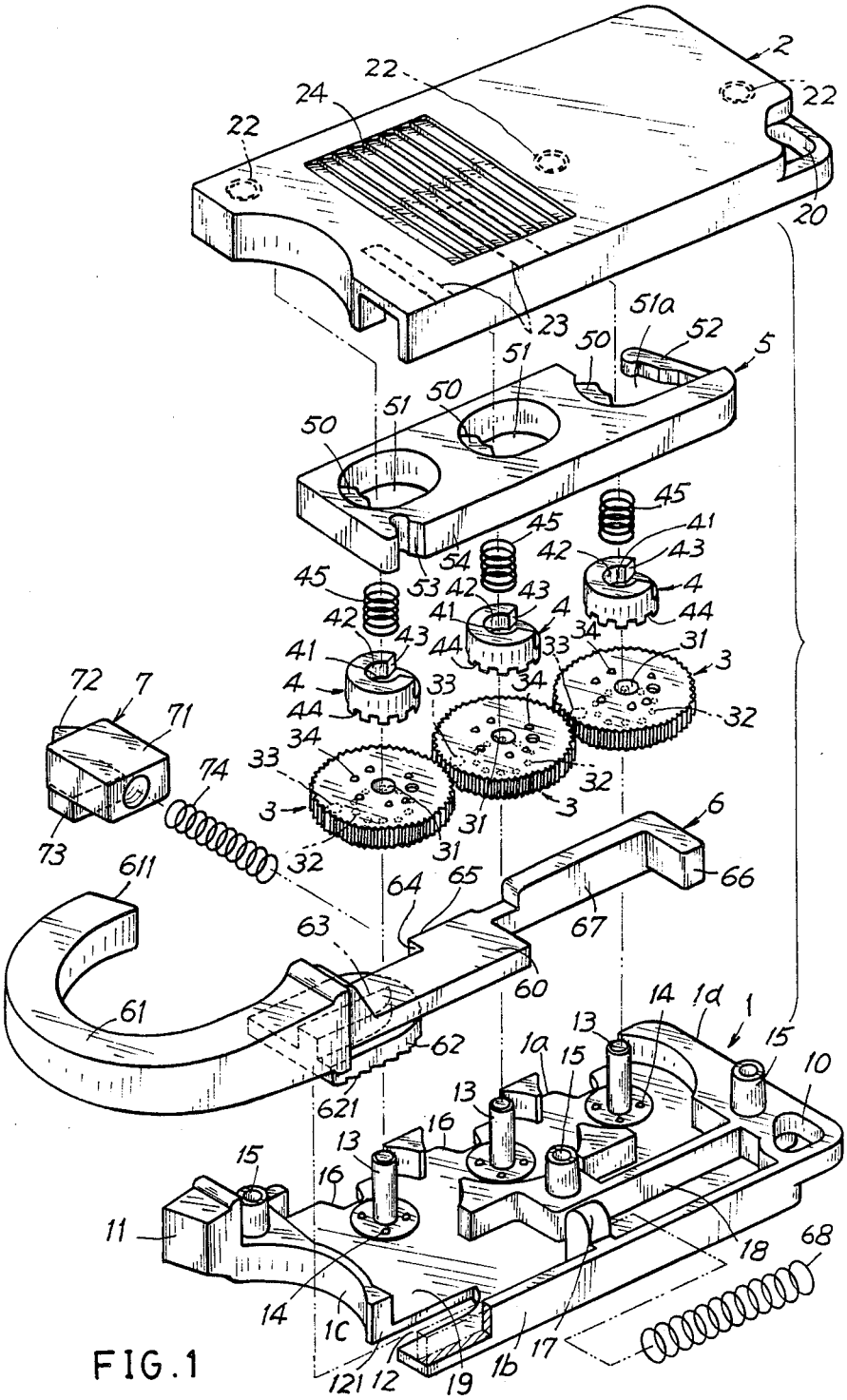
FIG. 1 is an illustration showing all elements in construction of the present invention.

As shown in the figures, the present invention comprises: a first cover 1, a second cover 2 in combination with the first cover 1 to form a casing of the padlock, a plurality of dials 3, a plurality of sleeves 4, a longitudinal slide member 5, a movable shackle means 6, and a lateral detent means 7. The integral casing of the padlock may be made to be a very thin, compact rectangular structure.

The first cover 1 includes: a fixed shackle portion 11 protruding outwardly from a first longitudinal side wall 1*a*, an elongate slot 12 formed on an upper side wall 1*c* (opposite to a bottom wall 1*d*) of the cover 1 proximate to a second longitudinal side wall 1*b* (opposite to the first longitudinal side wall 1*a*), a plurality of pivots 13 formed on a base surface 19 of the cover 1 proximate to the first side wall 1*a* for pivotally mounting the plurality of dials 3, a plurality of protrusions 14 formed on the base surface radially disposed around each pivot 13, a plurality of stems 15 formed on the base surface engageable with a plurality of sockets 22 formed in the second cover 2 for combining the two covers 1, 2, a plurality of notches 16 recessed from the first side wall 1*a* for revealing any one numeral 33 formed on each dial 3, a lateral extension 17 protruding inwardly from a middle portion of the second side wall 1*b* for retaining a restoring spring 68 of the movable shackle means 6, and an elongate extension 18 formed on the base surface proximate and parallel to the second side wall 1*b* for guiding a sliding movement of a rear portion of the shackle means 6.

The second cover 2, having plurality of side walls corresponding to all side walls 1*a*, 1*b*, 1*c*, 1*d*of the first cover 1, is formed with a through hole 20 in its one corner to form a chain opening 10, 20 in commensuration with another through hole 10 formed in the first cover so that the casing 1,2 can be held by a chain passing through the holes 20, 10. A bottom socket 21 is formed in the cover 2 for storing a rear spring plate 52 of the slide member 5 normally tensioning the slide member 5 towards a bottom side wall 1*d* of the casing 1, 2. Two transverse extensions 23 are formed proximate to an upper side wall 1*c* of the casing to movably define the detent means 7 in the two extensions. An opening 121 is formed on a corner of the casing 1,2 for reciprocatively moving the shackle means 6. A corrugate surface 24 may be formed on a back surface of the cover 2 adapted for a frictional holding by a user.

Each dial 3 includes: a central hole 31 for pivotally securing each dial 3 on each pivot 13, a plurality of recesses 32 radially disposed in a bottom surface of the dial 3 to resiliently engage each protrusion 14 formed on the cover 1 (as retained by spring 45 on each sleeve 4) to allow each dial 3 to be clickingly rotated in the casing, and a plurality of protrusions 34 formed on an upper surface of the dial 3 each resiliently engaging each recess 44 formed on a bottom surface of each sleeve 4.

Each sleeve 4 includes a central hole 41 for pivotally securing each sleeve 4 in the pivot 13 and superimposing each sleeve 4 on each dial 3, a central spring socket 42 for storing each tensioning spring 45 retained between the sleeve 4 and the second cover 2, a divergent notch 43 radially formed in an upper surface of the sleeve 4 through each spring socket 42 operatively engaging each tapered extension 50 formed on the slide member 5. After combining the covers 1, 2, the spring 45 will tension the sleeve 4 and the dial 3 for resiliently coupling the same.

The longitudinal slide member 5 is generally formed as a rectangular plate having a plurality of sleeve openings 51 longitudinally formed therein, each sleeve opening 51 having a length larger than a diameter of each sleeve 4 and a tapered extension 50 protruding downwardly towards a bottom side wall 1*d* from each opening 51 to operatively engage each divergent notch 43 of the sleeve 4, a rear spring plate 52 embedded in a socket 21 of the second cover 2 to normally tension the slide member 5 towards the bottom side wall 1*d*, a side notch 53 recessed in a longitudinal side wall of the slide member 5 facing the second side wall 1*b* for operatively engaging a wedge portion 72 of the lateral detent means 7. The rear opening 51*a* of the slide member 5 can be cut through its rear portion to form the spring plate 52 as shown in FIG. 1. Each tapered extension 50 is formed an arcuate surface 50*a* on its lower circumference to smoothly engage a perimeter of each sleeve 4 as shown in FIG. 2.

The movable shackle means 6 includes: a movable shackle portion 61 generally formed as C shape having an opening end 611 operatively closing the fixed shackle portion 11 formed on the cover 1 for locking the present padlock, a pusher plate 62 having corrugate or anti-slipping surface 621 formed thereon secured to a middle portion of the shackle means by a connecting plate 63 movably engaged with the slot 12 of the first cover 1 and slidably overlain outside the cover 1, an intermediate flat plate 60 formed on a middle portion thereof slidably laid on the base surface 19 of the cover 1 having a recess portion 64 recessed in a direction towards the second side wall 1*b* opposite to the first side wall 1*a* and having an extension portion 65 protruding towards the first side wall 1*a* from the recess portion 64, and a rear shank portion 67 protruding towards a bottom side wall 1*d* from the flat plate 60 having a bottom hook portion 66 formed on its rear end. The rear shank portion 67 may be inserted therein a restoring spring 68 to be held between the lateral extension 17 of cover 1 and the hook portion 66 to normally resiliently tension the shackle means 6 rearwardly towards the bottom side wall 1*d* for closing the movable shackle portion 61 on the fixed shackle portion 11 as shown in FIG. 2.

Figure 2:
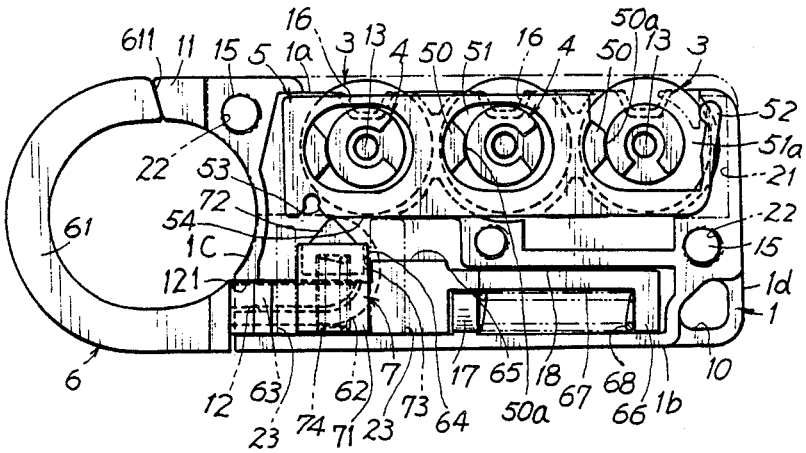
FIG. 2 is an illustration showing a locking condition of the present invention.
Figure 3:
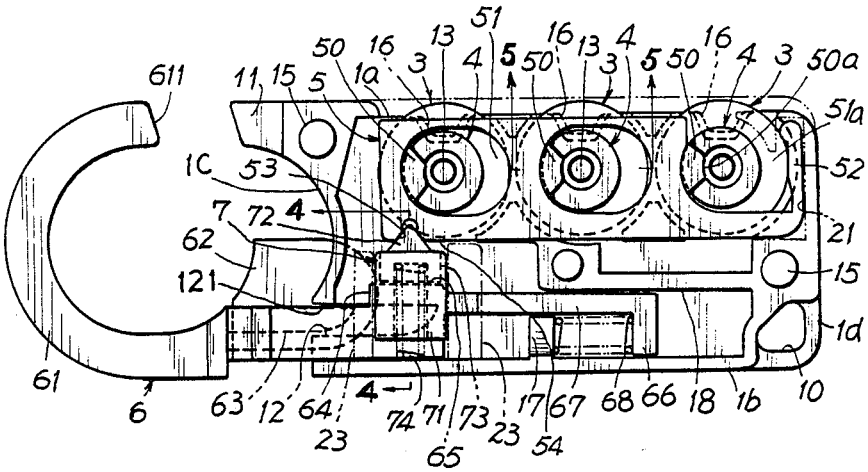
FIG. 3 shows an opening padlock of the present invention.
Figure 4:
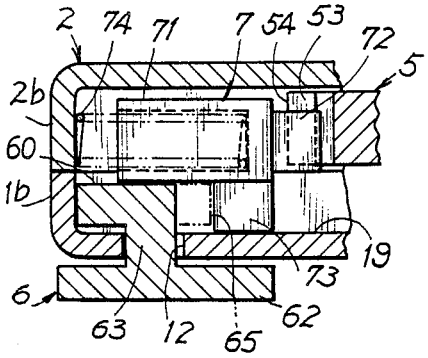
FIG. 4 is a cross sectional drawing of the present invention when viewed from 4—4 direction of FIG. 3.

The lateral detent means 7 as shown in FIGS. 1, 4, 2 and 3 includes: a slide plate 71 slidable retained between the flat plate 60 of shackle means 6 and the second cover 2, a wedge portion 72 tapered towards the first side wall 1*a* and protruding from the slide plate 71 to operatively engage the side notch 53 of the longitudinal slide member 5 as shown in FIG. 3, a base block 73 formed under the slide plate 71 slidably laid on the base surface 19 and operatively obstructing the recess portion 64 of the shackle means 6 as shown in FIG. 2, and a tensioning spring 74 resiliently tensioning the slide plate 71 and wedge portion 72 towards the first side wall 1*a*. The spring 74 is retained against the second longitudinal side wall 2*b* of the second cover 2 as shown in FIG. 4 to tension the detent means 7 towards the longitudinal slide member 5.

When using the present invention for locking purpose (from FIG. 3 to FIG. 2), the dials 3 have already been rotated to their locking state so as to allow the divergent notch 43 of each sleeve 4 to leftwardly thrust the tapered extension 50 of the longitudinal slide member 5 (the arcuate surface 50*a* of the extension 50 being resiliently engaged with a perimeter of the sleeve 4 as shown in FIG. 2), bearing the resilience of the spring plate 52 embedded in the socket 21, towards the upper side wall 1*c* or the shackle portion 61. Simultaneously, the side notch 53 formed in the side wall 54 will also thrust and retract the wedge portion 72 of the detent means 7 from the position shown in FIG. 3 to that as shown in FIG. 2 to allow the base block 73 to engage the recess portion 64 to obstruct the shackle means 6 to prevent from its leftward opening action when pushing the pusher plate 62 to open the shackle 61, thereby locking the present padlock as shown in FIG. 2.

Figure 5:
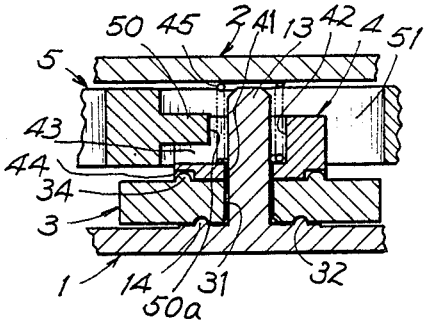
FIG. 5 is a sectional drawing of the present invention when viewed from 5—5 direction of FIG. 3.
Figure 6:
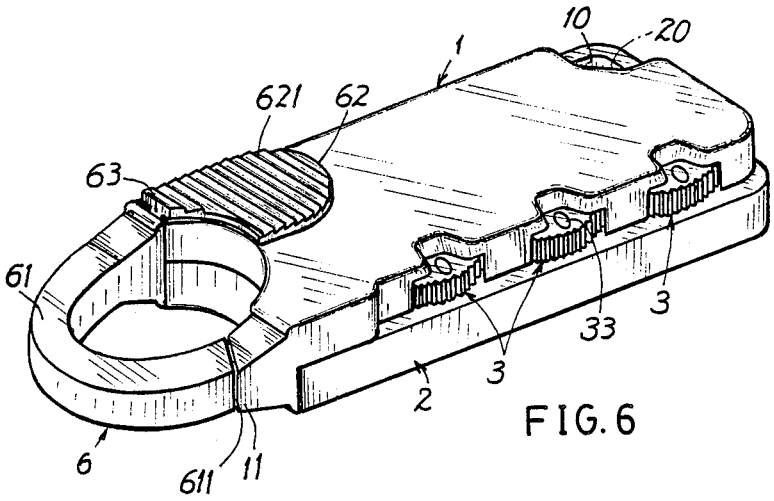
FIG. 6 is a perspective view of the present invention as assembled, by reversing the padlock as shown in foregoing drawings.

When it is intended to open the lock, the dials are rotated to their opening combination and the extensions 50 of the slide member 5 are engaged with the notches 43 of the sleeves 4 as shown in FIG. 3 and 5 since the slide member 5 is always retained towards the bottom side wall by the spring plate 52. Meanwhile, the side notch 53 is engaged with the wedge portion 72 of the detent means 7 which is tensioned towards the first side wall 1*a* by the spring 74 and the base block 73 is no longer obstructing the recess portion 64 of the shackle means 6 so that upon a leftward pushing of the pusher plate 62, the shackle portion 61 will be opened to open the present lock.

If for resetting a new combination of the present invention, the pusher plate 62 is firmly depressed by a user's hand when opening the lock as shown in FIG. 3. Since the base block 73 is backwardly retarded by the extension portion 65 of the shackle means 6, the wedge portion 72 as engaged with the notch 53 will "lock" the slide member 5 to allow its extensions 50 engaged with sleeve notches 43 to brake the rotation of all sleeves 4, thereby providing a free rotation of any one dial 3 for resetting a new combination of the present invention.

The present invention is superior to the applicant's previous U.S. Pat. No. 4,742,700 with the following advantages:

1. It is ergonomically comfortable to push the movable shackle to open the present lock, while still holding the casing of the lock very stably.

2. Since a thumb, for instance, may be used to outwardly push the pusher plate 62 of the shackle 6, the remaining fingers and hand portion of a user may firmly hold the lock casing 1, 2 without being injured by the moving parts (for example, the shackle portion 61) of the present lock.

3. The elements are integrated to form a compact unit having a smoother appearance and better aesthetic meaning than the U.S. Pat. No. 4,742,700 which is formed with a side locked shackle structure.

The numerals 33 disposed on the bottom surface of the dial 3 are separated from the base surface 19 of the first cover 1 to prevent from their wearing since the dial is rotatively engageable with the plural protrusions 14 formed on the base surface 19 having the bottom surface of the dial positioned slightly higher above the base surface 19 of the first cover.

The longitudinal slide member 5 is integrally formed with the spring plate 52 by an integrated molding process well known in plastic processing.

The fixed shackle portion 11 is formed with an angled extension inclined upwardly outwardly to retard a lateral outward pulling of the opening end 611 of the shackle means 6, of which the opening end 611 is formed as a sloping surface inclined inwardly downwardly, engageable with the angled extension of the fixed shackle portion 11.

I claim:

1. A pusher-type combination padlock comprising: a first cover generally formed as a rectangular shape composed of a first longitudinal side wall, a second longitudinal side wall opposite to said first side wall, a bottom transverse side wall, and an upper transverse side wall opposite to said bottom side wall, having a fixed shackle portion protruding outwardly from said upper side wall proximate to said first longitudinal side wall;

a second cover having plurality of side walls corresponding to all said side walls of said first cover combinable with said first cover to form a casing of the padlock;

a plurality of dials pivotally mounted on said first cover proximate to said first longitudinal side wall of said first cover;

a plurality of sleeves, each sleeve resiliently engaged with each said dial, each sleeve having a divergent notch formed therein; a longitudinal slide member normally resiliently retained towards a bottom side wall of said second cover having a plurality of sleeve openings each sleeve opening having a tapered extension engageable with the divergent notch of the sleeve, and having a side notch formed in a side wall of said slide member projectively facing said second longitudinal side wall of said first cover;

a movable shackle means slidably formed in the casing proximate to the second longitudinal side wall of said first cover, including a movable shackle portion operatively closing the fixed shackle portion for locking the padlock, and a pusher plate secured to said shackle means slidably overlain outside said first cover; and a lateral detent means resiliently tensioned towards said longitudinal slide member having a wedge portion protruding towards a first side wall of said second cover above said first side wall of said first cover, and a base block formed thereunder operatively engaging a recess portion of said shackle means for locking the padlock when retracting said detent means towards said second side wall of said first cover, said wedge portion being operatively engaged with said side notch of said slide member when tensioning said detent means towards said slide member to disengage the recess portion of the shackle means, enabling an outward pushing of said shackle means for opening the padlock.

2. A combination padlock according to claim 1, wherein said shackle means includes a movable shackle portion formed as a C shape operatively closing the fixed shackle portion, a pusher plate having an anti-slipping surface formed thereon secured to a middle portion of the shackle means by a connecting plate slidably moving in an elongate slot formed in the first cover for pushing the shackle means for opening the padlock, an intermediate flat plate formed on a middle portion of the shackle means secured to the movable shackle portion having said recess portion recessed from a side wall thereof towards the second longitudinal side wall of said first cover and having an extension portion protruding from said recess portion towards the first longitudinal side wall of said first cover, and a rear shank portion secured to the flat plate normally resiliently retained towards the bottom side wall of said first cover.

3. A combination padlock according to claim 2, wherein said rear shank portion of said shackle means includes a hook portion formed on its rear end for holding a restoring spring retained between said hook portion and a lateral extension formed on a middle portion of said second longitudinal side wall of said first cover to normally tension the shackle means rearwardly towards said bottom side wall of said first cover for closing the shackle means for locking the padlock.

4. A combination padlock according to claim 1, wherein said lateral detent means includes a slide plate slidably mounted on the flat plate of the shackle means, a wedge portion protruding towards the first side wall of said second cover from said slide plate to operatively engage the side notch of said longitudinal slide member, a base block formed under said slide plate slidably laid on a base surface of said first cover for operatively engaging and obstructing the recess portion of said shackle means when locking the padlock, and a tensioning spring tensioning said slide plate towards said first side wall against said second side wall of said second cover, whereby upon an engagement of the extensions of said slide member with said sleeve notches and an engagement of said wedge portion of said detent means with said side notch of said longitudinal slide member, said recess portion of said shackle means is no longer obstructed by said base block of said detent means to allow an outward pushing of said pusher plate to open said shackle means for opening the padlock.

5. A combination padlock according to claim 1, wherein said shackle means is reciprocatively moved when opening or closing the padlock through a shackle opening formed in the casing.

6. A combination padlock according to claim 1, wherein a rear shank portion is movably held in between an elongate extension formed on the base surface of the first cover and the second longitudinal side wall of said first cover.

7. A combination padlock according to claim 1, wherein said detent means is laterally guided in two transverse extensions formed on the second cover proximate to an upper side wall of said second cover.

8. A combination padlock according to claim 1, wherein each sleeve opening of said longitudinal slide member includes a tapered extension formed on the sleeve opening engageable with each divergent notch of said sleeve, having an arcuate surface formed on a lower circumference of the tapered extension engageable with a perimeter of said sleeve.

9. A combination padlock according to claim 8, wherein each said sleeve opening of said slide member has a length larger than a diameter of said sleeve, said divergent notch of said sleeve operatively thrusting said tapered extension of said slide member to move said slide member outwardly against a resilience of a spring plate of said slide member, thereby disengaging said a tapered extension from said divergent notch for locking the padlock.

10. A combination padlock according to claim 1, wherein said longitudinal slide member further includes a spring plate formed on its rear end embedded in a socket formed in the second cover to normally tension the slide member rearwardly towards the bottom side wall of the second cover of the casing.

11. A combination padlock according to claim 10, wherein said spring plate is directly formed in said slide member by directly cutting a rear sleeve opening in a rear portion of said slide member.

12. A combination padlock according to claim 10, wherein said longitudinal slide member is integrally formed with a spring plate by an integrated molding process.

13. A combination padlock according to claim 1, said slide member has said side notch divergent towards said second side wall of said second cover, engageable with the wedge portion of said detent means tapered towards said slide member when opening the padlock, and also operatively thrusting said wedge portion to disengage from the side notch of the slide member for locking the padlock.

14. A combination padlock according to claim 1, wherein a casing composed of said first cover and second cover further includes a chain opening formed through a corner of the casing for passing a chain therethrough.

15. A combination padlock according to claim 1, wherein each said dial has an outer periphery of a bottom surface of the dial positioned slightly higher above the base surface of said first cover to prevent from a wearing of plurality of numerals formed on the bottom surface of each said dial.

16. A combination padlock according to claim 1, wherein said movable shackle means has an opening end formed with a sloping surface inclined inwardly downwardly, engageable with an angled extension inclined upwardly outwardly formed on said fixed shackle portion of said first cover, said angled extension operatively retarding said opening end of said shackle means when laterally pulling said opening end outwardly.

* * * * *